United States Patent [19]

Markham et al.

[11] 4,431,480

[45] Feb. 14, 1984

[54] METHOD AND APPARATUS FOR CONTROLLED ADDITION OF ALKALINE CHEMICALS TO AN OXYGEN DELIGNIFICATION REACTION

[75] Inventors: Larry D. Markham, Middletown, Ohio; Vincent L. Magnotta, Coopersburg, Pa.

[73] Assignee: The Black Clawson Company, Middletown, Ohio

[21] Appl. No.: 315,672

[22] Filed: Oct. 27, 1981

[51] Int. Cl.[3] ..... D21C 3/02; D21C 9/00

[52] U.S. Cl. ..... 162/19; 162/57; 162/65; 162/243

[58] Field of Search ..... 162/19, 25, 26, 24, 162/28, 65, 90, 70, 57, 76, 52, 243, 246, 248, 63

[56] References Cited

U.S. PATENT DOCUMENTS

| | | | |
|---|---|---|---|
| 3,313,677 | 4/1967 | Carr | 162/19 |
| 3,725,194 | 4/1973 | Smith et al. | 162/65 |
| 3,769,152 | 10/1973 | Samuelson et al. | 162/65 |
| 4,198,266 | 4/1980 | Kirk et al. | 162/49 |
| 4,248,662 | 2/1981 | Wallick | 162/25 |

FOREIGN PATENT DOCUMENTS

| | | | |
|---|---|---|---|
| 30158 | 6/1981 | European Pat. Off. | 162/65 |
| 730909 | 4/1980 | U.S.S.R. | 162/65 |

OTHER PUBLICATIONS

Janson et al., "The Use of Unconventional Alkali in Cooking and Bleaching", No. 2, 1978 p. 89, Puperi ja Puce.

"Low-Consistency Oxygen Delignification System Uses Continuous Pipeline Reactor", Paper Trade Journal, Jul. 15, 1978.

Spraying Systems Company, Industrial Catalog 27, pp. 46–62, 1978.

*Primary Examiner*—Steve Alvo

*Attorney, Agent, or Firm*—Biebel, French & Nauman

[57] ABSTRACT

Good temperature and pH control as well as uniform mixing of pulp or other fibrous materials is achieved in a medium consistency oxygen delignification method and system. Alkaline chemicals are sprayed, optionally using oxygen gas as the atomizing agent, into the gas space above the level of pulp maintained in one or more substantially horizontal tubular reaction vessels. At least a part of the steam requirement of the reaction is added only after the major portion of alkaline chemicals has been added to the system. In other embodiments of the invention, alkaline chemicals may be injected into the substantially vertical conduit connecting two reaction vessels or two different alkaline chemicals may be injected at different points in the system.

11 Claims, 4 Drawing Figures

| CODE | ALKALI COMPOSITION % ON PULP (WT) | |
|---|---|---|
| | NaOH | NH3 |
| 1 | 1.2 | 3.75 |
| 2 | 3.0 | 3.0 |
| 3 | 6.0 | 1.7 |
| 4 | 10.0 | — |
| 5 | — | 4.25 |

METHOD AND APPARATUS FOR CONTROLLED ADDITION OF ALKALINE CHEMICALS TO AN OXYGEN DELIGNIFICATION REACTION

CROSS-REFERENCE TO RELATED APPLICATIONS

This application is related to U.S. application Ser. No. 72,796, entitled "Oxygen Delignification of Pulp Mill Rejects," filed Sept. 5, 1979; U.S. application Ser. No. 99,684, entitled "Apparatus and Method for Medium Consistency Oxygen Delignification," filed Dec. 3, 1979 now U.S. Pat. No. 4,363,697; U.S. application Ser. No. 184,514, entitled "Process and Apparatus for the Oxygen Delignification of Pulp," filed Sept. 5, 1980; and U.S. application Ser. No. 251,401, entitled "Method and Apparatus for Oxygen Delignification," filed Apr. 6, 1981.

BACKGROUND OF THE INVENTION

This invention relates to a process and apparatus for the oxygen delignification of fibrous materials, and more particularly to the medium consistency delignification of bleachable grade pulp and other fibrous materials using a series of substantially horizontal tubular reaction zones.

The control of pH during an oxygen delignification reaction has been recognized to provide beneficial effects such as improved pulp viscosity and strength as compared to simply adding the total charge of alkaline chemicals at the start of the reaction. For example, Grangaard et al., U.S. Pat. No. 2,926,114, teaches the oxygen delignification of wood chips by controlling the pH of the cooking liquor in the range of 7–9 during the major portion of the reaction. This pH control is achieved by using a buffer such as sodium bicarbonate in the liquor or by continuously adding alkaline chemicals such as sodium hydroxide or sodium carbonate throughout the reaction.

Samuelson, U.S. Pat. No. 3,769,152, teaches delignifying wood chips using an oxygen delignification process which involves the progressive addition of alkaline chemicals to maintain the pH of the cooking liquor in the range from about 9.5–13.

Kirk et al., "Low-Consistency Oxygen Delignification in a Pipeline Reactor," TAPPI, Vol. 61, No. 5 (May 1978) and Kirk et al., U.S. Pat. No. 4,198,266, teach that control of pH by the addition of alkaline chemicals in response to sensed pH changes along the length of a reactor produces improved pulp strength in an oxygen bleaching process on kraft pulp at 3% consistency compared to similar runs with no pH control.

Finally, Wallick, U.S. Pat. No. 4,248,662, describes an oxygen delignification system in which alkaline chemicals and recycled liquor are added along the length of a series of horizontal tubular reactors operating at from 3–8% consistency.

However, in all of the above described processes, the addition of alkaline chemicals during the oxygen delignification reaction presented no special problems with respect to uniform mixing of the added alkaline chemicals. In all of these processes of delignifying wood chips or pulp at low consistencies, free cooking liquor was available in addition to the liquor contained within the wood itself so that movement of the free liquor through the respective reactors served to distribute uniformly the added alkaline chemicals.

Processes which delignify pulp at medium (i.e., 8–20%) or high (i.e., 25–30%) consistencies do not have this free cooking liquor or only have insufficient quantities available to redistribute the added alkaline chemicals. Because the rate of oxygen delignification and the rate of alkaline chemical consumption increase dramatically as the concentration of alkaline chemicals increases, in areas of high alkaline chemical concentration the alkaline chemicals will be consumed rapidly before there is an opportunity for them to be redistributed. This may lead to pulp degradation in these areas. Additionally, high oxygen consumption in these areas may lead to oxygen starvation. All of these factors contribute to the production of a nonuniformly delignified pulp having less desirable strength and viscosity properties.

Attempts have been made to solve these problems in medium consistency operation by providing mixing equipment designed to mix uniformly the alkaline chemicals, oxygen, and pulp. For example, Kirk et al., U.S. Pat. No. 4,198,266, describes a "medium" consistency process which includes a plurality of mixing devices designed to generate high shear forces. Nasman et al., "Medium Consistency Oxygen Bleaching—An Alternative to the High Consistency Process," TAPPI, Volume 63, No. 4 (April 1980), describes a pilot plant operation which utilizes a steam mixer to mix steam and alkaline chemicals with the pulp and an oxygen mixer to disperse oxygen gas into the pulp prior to a vertical reactor. However, the use of such mixers is both complicated and expensive, especially when alkaline chemicals must be added at several locations during the delignification reaction. Moreover, the high shear forces created by such mixers may themselves cause degradation of the pulp.

Accordingly, the need still exists in the art for a relatively simple and economical process and apparatus providing uniform mixing and the controlled addition of alkaline chemicals to a medium consistency process for the oxygen delignification of pulp or other fibrous materials.

SUMMARY OF THE INVENTION

The present invention meets that need by providing a process and apparatus for the controlled addition and uniform mixing of alkaline chemicals in a medium consistency oxygen delignification system. In accordance with one embodiment of the invention, pulp or other fibrous materials at medium consistency (i.e., 8–20%) are combined with a first portion of alkaline chemicals just prior to the introduction of the pulp into a substantially horizontal, tubular reaction vessel. Preferably, a thick stock pump is used to feed the pulp into the reaction vessel. Use of the thick stock pump prevents the loss of gas pressure from the vessel and does not severely compact the pulp so that uniform oxygenation can occur.

The reaction vessel includes a mixing and conveying screw which preferably extends along substantially the entire length of the vessel. Modification may be made to the screw design to improve its mixing capabilities as is taught in copending U.S. application Ser. No. 99,684, filed Dec. 3, 1979. The screw will transport the pulp through the vessel in essentially plug flow. In operation, the level of pulp maintained in the vessel is less than the volume of the vessel so that a gas space is formed along the upper side of the vessel.

When the remainder of the charge of alkaline chemicals is introduced into the reaction vessel, it is done so by spraying the alkaline chemicals as dispersed droplets into the gas space in the reaction vessel. In a preferred embodiment, at least a portion of the oxygen gas supplied to the reaction vessel is used in conjunction with an atomizing nozzle to spray the alkaline chemicals into the gas space. The remainder of the oxygen gas requirement may be introduced separately.

By combining the oxygen gas and alkaline chemicals and spraying the mixture into the gas space above the pulp bed, good temperature and pH control of the reaction as well as uniform delignification is achieved. Generally, the temperature of the oxygen gas and alkaline solution will be less than the temperature of the pulp in the reaction vessel so that the mixture of oxygen and alkaline chemicals will not have a heating effect on the pulp. This permits the oxygen and alkaline chemicals to be mixed uniformly with the pulp mass before they are consumed by the delignification reaction.

An important aspect of controlling the temperature in the reaction vessel is that at least a portion of the heat requirement for the reaction is supplied by introducing steam into the reaction vessel only after the addition of the major portion of alkaline chemicals. The alkaline chemicals and oxygen are allowed to mix thoroughly with the pulp, and some heating of the pulp will occur due to the exothermic delignification reaction. Only then is steam added to the vessel, preferably by adding it through one or more inlets adjacent the gas space above the level of pulp in the reaction vessel. This avoids overheating and possible degradation of the pulp which can occur if all of the steam were added prior to or during the addition of the alkaline chemicals or were added directly into the pulp bed.

In another embodiment of the invention, a plurality of substantially horizontal reaction vessels may be utilized to oxygen delignify pulp at medium consistency. In this system, the outlet of the first reaction vessel is connected to the inlet of the second reaction vessel via a vertical conduit, the outlet of the second vessel is connected to the inlet of a third vessel, and so on if needed.

A first portion of the alkaline chemical charge is added to the pulp prior to its entry into the first reaction vessel. In the first reaction vessel, oxygen gas is introduced, and the mixing screw agitates the pulp, oxygen, an alkaline chemicals to initiate delignification. The remainder of the alkaline charge is combined with the partially delignified pulp near the outlet of the first reaction vessel or in the conduit connecting the first and second reaction vessels. The remainder of the charge of alkaline chemicals is contacted with the pulp as it falls through the vertical conduit and is mixed uniformly with the pulp as it impacts into the succeeding vessel. Further delignification occurs in the second reaction vessel where more oxygen gas is consumed and more oxygen may optionally be added. The procedure may be further repeated in subsequent reaction vessels if a greater degree of delignification is desired. A portion of the heat required for reaction may be supplied by injecting steam into the vertical conduit between the first and second reaction vessels to take advantage of the mixing achieved by the tumbling of pulp as it passes through the conduit.

In yet a further embodiment of the invention, different alkaline chemicals are utilized at different stages of the medium consistency oxygen delignification reaction. This embodiment of the invention has particular applicability in the case of a sulfite pulp mill, where it is advantageous to use the same type of alkaline chemical, either ammonia, calcium hydroxide, magnesium hydroxide, or sodium hydroxide, that is compatible with the recovery system for that particular mill. In this way, the dissolved solids from the oxygen delignfication stage can be sent to the recovery system without any detrimental effect on the operation of the recovery system.

In using ammonia, calcium hydroxide, or magnesium hydroxide, however, the rate of oxygen delignification is quite low so that high reaction temperatures and long retention times are required. It would be desirable to use sodium hydroxide for at least a portion of the charge of alkaline chemicals in the above cases. But, because the pulp which enters the oxygen delignification reactor contains amounts of entrained acidic sulfite liquor which reacts rapidly with sodium hydroxide and oxygen, the sodium hydroxide is substantially consumed before it can take part in the delignification reaction.

This embodiment of the invention solves that problem by providing for the separate addition of sodium hydroxide to the pulp containing entrained sulfite liquor only after an initial charge of a different alkaline chemical has been added. Thus, a charge of a first alkaline chemical, such as ammonia, may be added to the pulp prior to its entry into the reaction vessel. Once in the vessel, a second charge of alkaline chemical containing sodium hydroxide is sprayed into the gas space above the level of pulp maintained in the reactor after sufficient time (at least ten seconds) has elapsed for the first alkaline chemical to have reacted with the entrained sulfite liquor. In this manner, an improved rate of delignification is obtained.

The rection conditions used for the process and apparatus of the present invention are dependent on the feed material. In general, however, an operating temperature of 70°–160° C. in the reaction vessel has been found to be suitable. Retention times in the reaction vessel may vary from 5–120 minutes, oxygen partial pressure may vary from 20–300 psig, and the total alkaline chemical charge may vary from 0.5–30% calculated as $Na_2O$ based on the oven dry weight of material.

Many types of alkaline chemicals may be used in the practice of the present invention. These include sodium hydroxide, sodium carbonate, sodium bicarbonate, kraft white liquor, oxidized kraft white liquor, ammonia, sodium tetraborate, sodium metaborate, or mixtures thereof. In some instances, the use of mixtures of alkaline chemicals may provide beneficial results such as increased delignification rates while maintaining pulp yield selectivity. For example, in delignifying sulfite pulps, the use of one alkaline chemical in combination with another which is compatible with the mill recovery system can achieve good results.

In some cases it may be desirable to use as an additive a protector chemical such as magnesium sulfate, magnesium hydroxide, magnesium oxide, magnesium carbonate, or other known additives to help maintain a high pulp viscosity during the oxygen delignification reaction. However, such additives are optional and not necessarily required.

The consistency of the pulp in the reaction vessel or vessels should be maintained in the range of from 8–20%. Use of pulp consistency of less than 8%, while possible, has the disadvantages of increased steam demand and oxygen and alkaline chemical consumption. Moreover, the volume of the reactor vessel must be increased accordingly. Use of a pulp consistency above 20%, while also possible, has the disadvantages of increased complexity because of the need for extra equipment to reach the higher consistency and greater difficulty in achieving uniform mixing of the pulp and alkaline chemicals.

The process and apparatus of the present invention are suitable for the delignification of any type pulp or other fibrous material at any yield level including kraft, sulfite, NSSC, polysulfide, chemimechanical, thermomechanical, and mechanical pulps as well as agricultural fibers such as bagasse or straw. In general, the benefits of practicing the present invention, including higher pulp viscosity, better pulp strength, and higher pulp yield, are most apparent when a large amount of delignification, for example 20 or more Kappa units, is accomplished in the reaction.

Accordingly, it is an object of the present invention to provide a process and apparatus for the controlled addition and uniform mixing of alkaline chemicals with pulp in a medium consistency oxygen delignification process. This and other objects and advantages of the invention will become apparent from the following description, the accompanying drawings, and the appended claims.

DESCRIPTION OF THE PREFERRED EMBODIMENT

Figure 1:
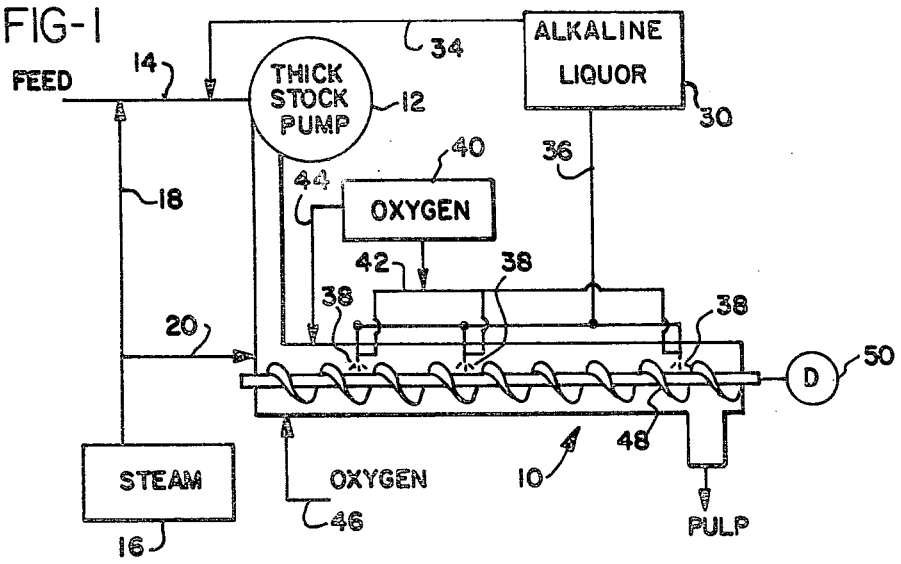
FIG. 1 is a schematic flow diagram illustrating one embodiment of the process and apparatus of the present invention.

As illustrated in FIG. 1, a pulp feed stream at from 8–20% consistency, and preferably 10–15% consistency, is introduced into a first substantially horizontal reaction vessel 10 by a thick stock pump 12. This medium consistency of from 8–20% should be maintained throughout the reaction for best results. By "substantially horizontal," it is meant that inclined reaction tubes may also be employed, but the angle of incline should not exceed approximately 45 degrees to avoid compression and dewatering of the pulp in the lower end of the vessel which will interfere with uniform mixing. Additionally, while the reaction vessel is illustrated as a generally cylindrical reactor tube, non-cylindrical tubes such as a twin-screw system may be utilized.

Pump 12 may be a Moyno progressing cavity pump available from Robbins & Myers, Inc., Springfield, Ohio. Alternatively, pump 12 may be a Cloverotor pump available from the Impco Division of Ingersoll-Rand Co., Nashua, N.H., or a thick stock pump manufactured by Warren Pumps, Inc., Warren, Mass.

It has been found that these pumps are capable of feeding the pulp into the reaction vessel against the pressure in that vessel without severely compacting the pulp and without any gas losses from the vessel. Other feeding devices such as rotary valves or screw feeders are not as desirable for use in the invention. A rotary valve allows substantial gas loss from the reaction vessel due to the rotation of valve pockets which are alternately exposed to the high oxygen pressure in the vessel and then to the atmospheric pressure external to the reactor. Use of a screw feeder results in the severe compression and dewatering of pulp so that efficient oxygenation and mixing at the proper consistency range cannot occur.

Prior to introducing the pulp into thick stock pump 12, a portion of the steam requirement for the reaction may be introduced into feed line 14 from steam source 16 via steam line 18. The addition of steam aids in expelling excess air from the pulp and also raises the temperature of the pulp somewhat.

However, it is important to the practice of the present invention that at least a portion of the steam required to maintain a proper reaction temperature be added only after the major portion of the charge of alkaline chemicals has been added to the reaction vessel. This permits the alkaline chemicals and pulp initially to mix thoroughly with only some heating of the pulp due to the exothermic delignification reaction. This process of adding steam avoids pulp degradation problems which could occur due to overheating of the pulp if all of the steam were added to the reaction vessel prior to or during the addition of the alkaline chemicals.

As shown in FIG. 1, the remainder of the steam requirement may be added to vessel 10 through line 20. Preferably, when steam is added to reactor vessel 10 it should not be added below the surface of the pulp in the vessel. This could lead to overheating and degradation of the pulp. Rather, the steam should be added through one or more inlets into the gas space above the pulp.

Alkaline chemicals including mixtures of different chemicals are supplied to reaction vessel 10 from alkaline liquor source 30. Typically, the total charge of alkaline chemicals will be from 0.5–30% by weight of the pulp calculated as $Na_2O$ on oven dry material. It is desirable to add a portion of the alkaline chemicals to the pulp prior to the entry of the pulp into reaction vessel 10. As shown in FIG. 1, alkaline liquor from source 30 is supplied via line 34 to the pulp in feed line 14. The alkaline liquor serves to lubricate the pulp for easier pumping as well as to insure that the pulp mass will have an alkaline pH when it enters the reaction vessel.

The remainder of the charge of alkaline chemicals is introduced into reaction vessel 10 via line 36 into a plurality of spray nozzles 38. To achieve the uniform mixing of the alkaline chemicals with the pulp at medium consistency operation without the use of expensive and elaborate mixing equipment, the solution of alkaline chemicals must initially be subdivided into droplets and injected into the gas space above the pulp mass. Several nozzles are commercially available which can produce the necessary fine or atomized spray of alkaline solution.

While the use of steam as an atomizing agent is possible, it is not preferred for use in the practice of the present invention. This is because the hot alkaline spray which is formed will react very quickly with the pulp on the surface of the bed before it can be adequately mixed. This leads to pulp degradation. Moreover, temperature control in the reaction vessel becomes difficult to achieve because the hot alkaline spray accelerates the exothermic oxygen delignification reaction so that overheating of the pulp can result. Thus, it is important in the practice of the present invention that at least a portion of the steam requirement for the reaction be added separately from the alkaline chemicals, and most preferably only after the major portion of the alkaline chemicals have been added to the reaction vessel.

In one embodiment of the invention, a fine spray of alkaline solution is generated using spray nozzles such as the type SM Solid-Jet nozzle available from William Steinen Manufacturing Co. or the full jet nozzle from Spraying Systems Co. These nozzles create a sufficiently fine spray. However, because of their relatively small orifices, there may be a need to provide an in line filter to remove particles and other contaminants from the alkaline solution. This is particularly true when kraft white liquor is used as the alkaline solution since it will always contain some calcium carbonate, known as "lime mud," from the causticizing operation.

In another embodiment of the invention, the fine spray of alkaline solution is created by injecting oxygen gas from oxygen source 40 through line 42 into the alkaline solution to produce an atomized spray. This may be accomplished, for example, using an Air Atomizing nozzle from Spraying Systems Co. The orifices of such nozzles may be selected to be of relatively large dimensions to avoid clogging or fouling problems. Additional oxygen may be supplied to reaction vessel 10 by adding it to the gas space above the pulp bed through line 44 or by sparging it through the pulp bed through line 46. However, sparging is not necessary because of the excellent mixing provided in the vessel.

Typically, the oxygen partial pressure maintained in the system is from about 30–200 psig. Spent gas may be removed from the system by venting it to the atmosphere. Alternatively, it may be recovered for recycle to the reaction or may be used for other purposes. Any organic vapors or carbon monoxide produced during the delignification reaction can be removed by passing the gas through a catalyst bed.

Uniform mixing of the pulp, oxygen, and alkaline chemicals is achieved by the gentle but thorough agitation provided by mixing screw 48 driven by suitable drive means 50 in vessel 10. The speed of rotation of the screw can be varied as well as providing modified screw flights to improve mixing as is taught in copending U.S. application Ser. No. 99,684, filed Dec. 3, 1979. The speed of rotation of screw 48 is controlled to transport the pulp forward in essentially plug flow and to maintain the vessel less than full of pulp, preferably 50–90% full, so that a gas space remains at the top of the vessel. The continuous movement of the gas and pulp along the length of the reaction vessel and the exchange between gas trapped in the pulp and free gas above the pulp prevents the formation of hot spots or pockets of potentially explosive gases and enhances uniform delignification of the pulp. Total retention times in the system may vary depending upon the nature and condition of the pulp and the desired amount of delignification to be achieved. Retention times of between 5 and 120 minutes have been found to be satisfactory.

Figure 2:
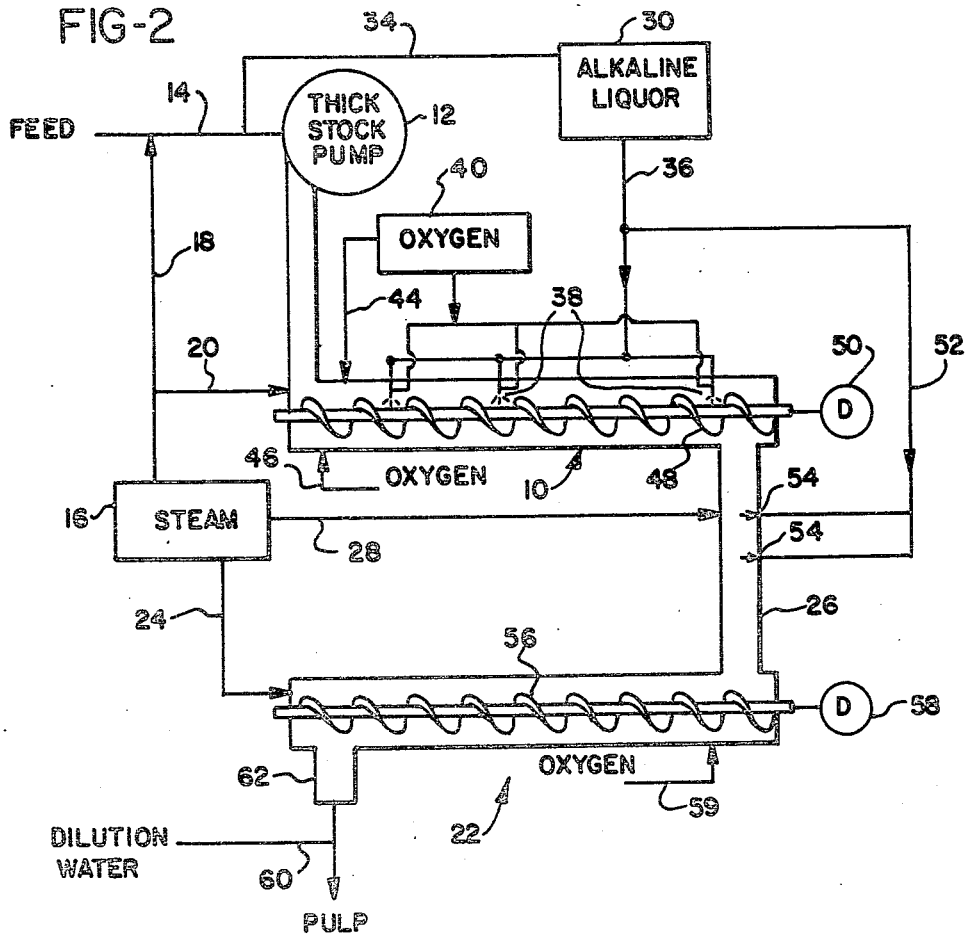
FIG. 2 is a schematic flow diagram illustrating another embodiment of the invention.

While in many cases satisfactory delignification can be achieved using a single reaction vessel, in some cases, it may be desirable to provide a plurality of reaction vessels in which delignification of the pulp takes place. As illustrated in FIG. 2, where like components are represented by the reference numerals, after traversing vessel 10, the pulp is introduced into second reaction vessel 22 through vertical conduit 26. A portion of the alkaline chemical charge may be introduced into the pulp through line 52 and spray nozzles 54 as the pulp tumbles through conduit 26. The impact of the pulp hitting the bottom of vessel 22 serves to mix uniformly the pulp and alkaline chemicals. Further steam may also optionally be added at this point through line 28 to maintain the preferred operating temperature range of 70°–160° C. in the system. Additional steam may also be provided through line 24 to the gas space above the level of pulp in vessel 22.

An internal mixing screw 56 in vessel 22 is driven by suitable drive means 58 and transports the pulp mixture along the length of the vessel in substantially plug flow. Additional oxygen gas may be supplied through line 59 which can be located either above or below the level of pulp maintained in vessel 22. Again, the speed of rotation of the timing screw can be varied to control the retention time and the level of the pulp to allow for adequate delignification. Further reaction vessels (not shown) may be utilized if necessary. The pulp is withdrawn from outlet 62 of vessel 22 and passed to a blow chamber where it is contacted with dilution water or liquor from line 60. From there it may be sent to a washing operation.

In some cases it may be advantageous to employ two different alkaline chemicals in the oxygen delignification reaction at different stages of the reaction. In the embodiment shown in FIG. 3, where like components are represented by like reference numerals, such a two alkaline chemical system is illustrated. A first alkaline chemical solution from alkaline liquor source 30 is supplied through line 34 to the pulp in feed line 14. After entering reaction vessel 10, a second alkaline chemical from alkaline liquor source 32 may be sprayed over the pulp by spray nozzles 38. Oxygen gas may optionally be used to atomize the second alkaline solution by spraying it through line 42. Alternatively, the oxygen may be supplied through line 44. In yet another alternative arrangement, the pulp may be permitted to be transported through vessel 10 to allow time for the first alkaline chemical to react completely before the second alkaline chemical is supplied through line 52 and nozzles 54 to pulp falling through vertical conduit 26. Suitable valving arrangements (not shown) direct the oxygen gas and alkaline liquor to the proper locations.

Figure 3:
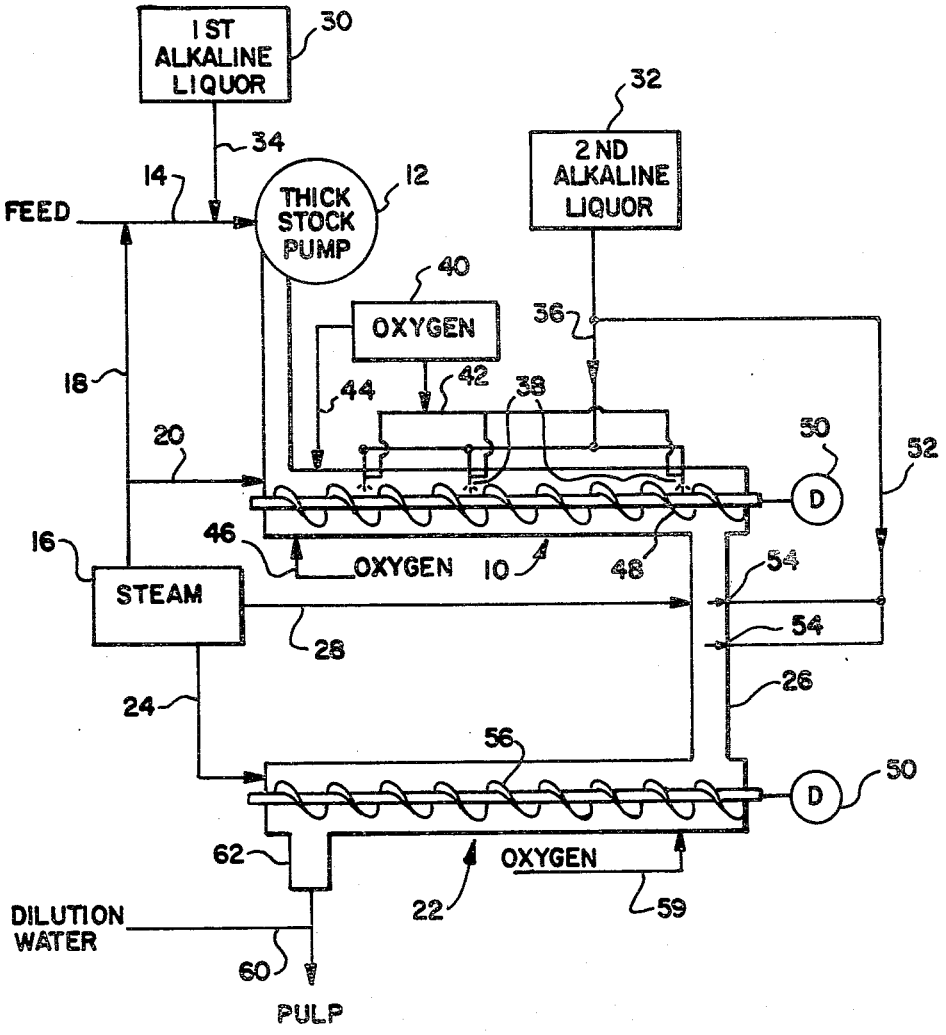
FIG. 3 is a schematic flow diagram illustrating yet a further embodiment of the invention.

The embodiments illustrated in FIG. 3 is particularly applicable in the case of pulp coming from a sulfite mill. It is beneficial when delignifying such pulp to use an alkaline chemical which is compatible with the mill's recovery system such as ammonia, calcium hydroxide, or magnesium hydroxide. However, these alkaline chemicals do not provide as rapid a delignification as sodium hydroxide. The present invention permits the use of a first alkaline chemical compatible with the sulfite mill recovery system in the initial stages of the reaction to neutralize any entrained sulfite liquor followed by the addition of a second alkaline chemical, such as sodium hydroxide, to accelerate the rate of delignification of the pulp.

In order that the invention may be better understood, reference is made to the following non-limiting examples.

EXAMPLE 1

Two runs were performed in a horizontal tube reactor equipped with a horizontal rotating shaft having paddle flights. Oxygen was injected into the gas space of the reactor above the level of the pulp. Alkaline solution was injected into the gas space above the pulp bed through a perforated tube having about 20 perforations to subdivide the stream. Oxygen gas pressure was used to inject the alkaline solution. Steam was added separately from the alkaline solution into the reactor.

The starting pulp was a Kappa 60.8 softwood kraft pulp. The reaction conditions used for the oxygen delignification were 110° C., 110 psig total pressure, 15 minutes retention time, 15% pulp consistency, 0.3% $MgSO_4$ dosage on the o.d. pulp, and 20 RPM rotational speed of the paddle flights. In Run 1-A, an alkaline chemical dosage of 6% NaOH was added to the pulp before the pulp was placed in the reactor. In Run 1-B, a dosage of 2% NaOH was added to the pulp before being placed in the reactor, and a dosage of 4% NaOH was sprayed into the gas space above the pulp as described above. This alkaline solution was injected gradually during the first two minutes of the fifteen minute reaction period. The results of these two runs are shown below:

| | Run #1-A | Run #1-B |
|---|---|---|
| Kappa No. | 26.4 | 26.9 |
| Viscosity (cps) | 23.9 | 28.7 |
| Strength Properties | (at a bulk of 1.5 $cm^3/g$) | |
| Burst Index | 8.1 | 9.0 |
| Breaking Length (km) | 12.4 | 13.0 |
| Tear Index | 11.6 | 12.5 |

It is evident that an improvement in both pulp viscosity and pulp strength can be achieved by the use of the process of the present invention.

EXAMPLE 2

The effect of using two different alkaline chemicals for the oxygen delignification of ammonium sulfite mill rejects was tested. Ammonium sulfite mill rejects having an initial screened Kappa number of 70 were placed in a reactor. The reaction conditions used for the oxygen delignification were 120° C., 150 psig total pressure, 30 minutes retention time, 15% pulp consistency, and 10% alkaline dosage calculated as sodium hydroxide based on oven dry pulp.

Figure 4:
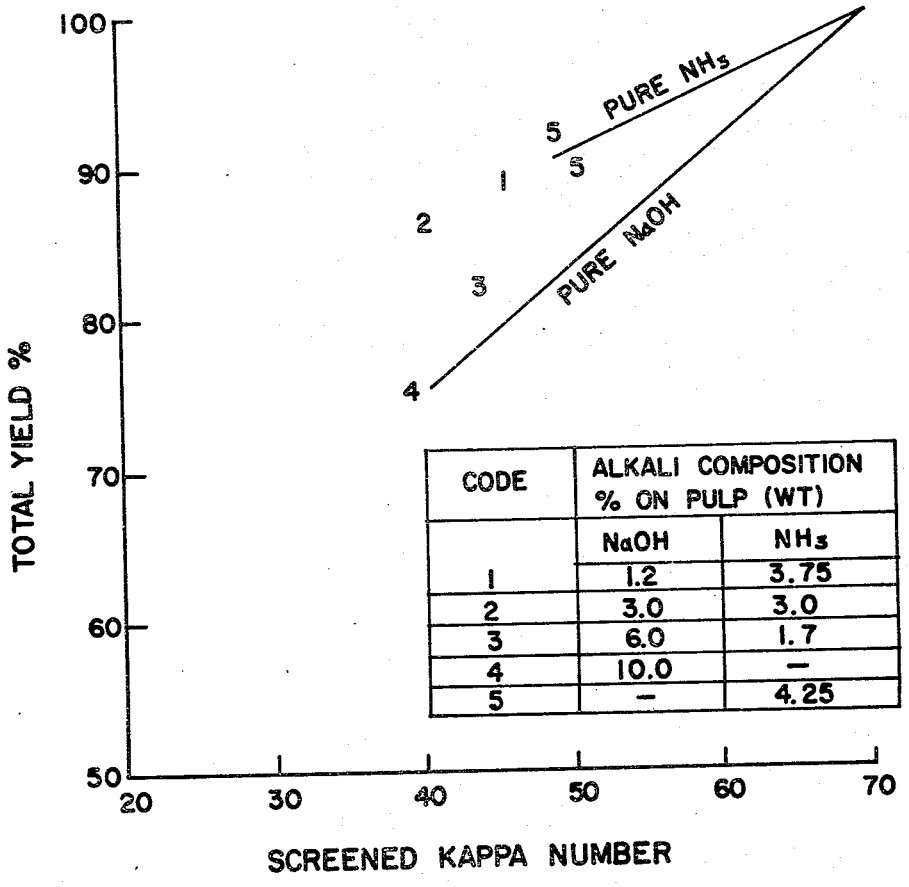
FIG. 4 is a graph of the effect on the total pulp yield versus Kappa number for different combined alkaline chemical charges.

The results are illustrated in FIG. 4. As can be seen, pure ammonia is more yield selective than pure sodium hydroxide as the alkaline source. However, the rate of delignification is slower using ammonia as compared to sodium hydroxide. The addition of sodium hydroxide to the pulp in amounts up to a 1:1 weight ratio with ammonia improves the delignification rate without decreasing the yield selectivity (points 1 and 2). Further substitution of sodium hydroxide for ammonia results in no further rate improvement and decreases yield selectivity (points 3 and 4). The test show that for the particular reaction system tested, the addition of sodium hydroxide to ammonia in a weight ratio of up to 1:1 in an oxygen delignification reaction is beneficial to the rate of delignification without adversely affecting yield selectivity.

EXAMPLE 3

Using the same equipment as in Example 1 and the same method of adding the alkaline solution as described in Example 1, a softwood magnesium sulfite pulp of Kappa No. 30.5 and viscosity 28.8 cps. was delignified using oxygen at 110 psig total pressure, 15% pulp consistency, 140° C. reaction temperature, and 22 min. retention time. The speed of rotation of the paddle flights was 20 RPM for the first 2 min. retention time and 3 RPM for the final 20 min. retention time.

In Run #2-A, a dosage of 2% $Mg(OH)_2$ on o.d. pulp was added to the pulp before it was placed in the reactor. In Run #2-B, the method was the same as #2-A except that a dosage of 0.5% NaOH on o.d. pulp was injected during the first 2 min. of the retention time but after the magnesium hydroxide had been allowed to react for at least 10 seconds. In Run #2-C, the method was the same as for #2-B, except that spent magnesium sulfite liquor having a pH of 3.0 was added to the starting pulp so that there was a quantity of 3% spent sulfite liquor solids on o.d. pulp. Run #2-C therefore simulated the actual mill situation where there would be carryover of spent sulfite liquor with the pulp entering the oxygen delignification stage.

| | Run #2-A | Run #2-B | Run #2-C |
|---|---|---|---|
| Kappa No. | 18.2 | 15.8 | 16.3 |
| Viscosity (cps) | 26.9 | 26.0 | 25.8 |

The results show that this method of adding alkaline chemicals produces an advantage in delignification rate even when spent sulfite liquor solids are present on the pulp. In other words, the spent sulfite liquor solids react very quickly with the $Mg(OH)_2$ and oxygen before the NaOH is added, so that the NaOH then reacts with the lignin in the pulp instead of with the sulfite liquor solids, and therefore, produces the desired increase in delignification rate.

EXAMPLE 4

The equipment used for this test was a continuous 6 ton/day pilot plant consisting of three tubular reactor vessels having internal mixing screws. The first vessel was inclined at an angle of about 20° from the horizontal, and the other vessel were horizontal. The pulp which was delignified with oxygen was a softwood kraft pulp having an initial Kappa number of 29.3 and a viscosity of 26.9 cps. The reaction conditions used were 113° C. reaction temperature, 100 psig total pressure, 10% pulp consistency, and 16 minutes retention time. A dosage of 1.5% NaOH on o.d. pulp was added to the pulp before it was pumped into the pressurized system using a thick stock pump. A further dosage of 1.5% NaOH on o.d. pulp was added by spraying the alkaline solution from two nozzles located in the vertical conduit connecting the first and second reactor vessels. To assist in atomizing the spray of NaOH solution, a small amount of steam was added through the same nozzles. However, the actual temperature control of the system was achieved by addition of steam through separate inlet ports in the first and third reactor vessels. Therefore, the mixing of steam with the pulp for good temperature control throughout the system was achieved separately from the alkaline injection system.

The oxygen delignified pulp from this test had a Kappa No. of 12.4 and a viscosity of 16.0 cps. This demonstrated that an abnormally large degree of delignification (58%) was achieved while still maintaining a good pulp viscosity.

EXAMPLE 5

The equipment used was the same as in Example 4. The starting pulp was a softwood kraft pulp having a Kappa No. of 57.0 and a viscosity of 30.2 cps. The reaction conditions were 100 psig total pressure, 15 minutes retention time, 120° C., and 10% pulp consistency. A dosage of 2% NaOH on o.d. pulp was added to the pulp prior to the thick stock feed pump, and a further dosage of 2% NaOH was added using a spray nozzle into the first reactor vessel. A Steinen SM 41 spray nozzle was used, and the flow rate of NaOH solution was 0.22 gallons/min. To achieve good delignification without pulp degradation, the alkaline solution was mixed uniformly with the pulp by (a) spraying it into the gas space above the pulp, (b) adding all of the steam separately from the alkaline solution via steam addition ports in the reactor vessels to achieve good temperature control throughout the system, and (c) by operating the mixing screw in the first reactor vessel at a relatively fast speed of 15.4 RPM.

The oxygen delignified pulp from this test had a Kappa No. 30.3 and a viscosity of 19.4 cps. A large amount of delignification (26.7 Kappa points) was achieved with a relatively small viscosity loss (10.8 cps).

EXAMPLE 6

The equipment and method used was the same as in Example 5. The starting pulp was a softwood sulfite pulp having a Kappa number of 28.5 and a viscosity of 34.8 cps. The reaction conditions were 100 psig total pressure, 22 minutes retention time, 138° C., and a 10% pulp consistency. A dosage of 2% $Mg(OH)_2$ on o.d. pulp was added to the pulp prior to the thick stock pump, and a further dosage of 0.5% sodium hydroxide was sprayed over the pulp as in Example 5 in the first reactor vessel.

The oxygen delignified pulp from this test had a Kappa number of 16.4 and a viscosity of 26.9 cps. A good amount of delignification (12.1 Kappa units) was achieved while maintaining a high pulp viscosity.

While the methods and apparatus herein described constitutes preferred embodiments of the invention, it is to be understood that the invention is not limited to these precise methods and apparatus, and that changes may be made in either without departing from the scope of the invention, which is defined in the appended claims.

What is claimed is:

1. Apparatus for the continuous oxygen delignification of pulp comprising in combination: a substantially horizontal tubular reaction vessel having an inlet and an outlet, means for supplying pulp to said inlet while maintaining a gas space at the top of said vessel above the level of said pulp, means for agitating and transporting said pulp through said reaction vessel to the outlet thereof, means for withdrawing delignified pulp from said reaction vessel, and means in said reaction vessel located above the level of pulp contained in said vessel for creating a fine spray of alkaline chemicals by injection of oxygen gas and alkaline chemicals to said gas space above the level of said pulp, said means for creating a fine spray including an atomizing nozzle, a first line communicating with said atomizing nozzle for supplying alkaline chemicals to said atomizing nozzle, and a second line communicating with said atomizing nozzle for injecting oxygen gas into said alkaline chemicals in said atomizing nozzle to create said fine spray.

2. Apparatus for the continuous oxygen delignification of pulp comprising in combination: a substantially horizontal tubular reaction vessel having an inlet and an outlet, means for supplying pulp to said inlet while maintaining a gas space at the top of said vessel above the level of said pulp, means for agitating and transporting said pulp through said reaction vessel to the outlet thereof, means for introducing oxygen gas into said gas space at the top of said reaction vessel, a first source of supply for a first alkaline chemical, first means communicating with said first source of supply for supplying said first alkaline chemical to said pulp prior to said inlet to said reaction vessel, a second source of supply for a second alkaline chemical, and second means communicating with said second source of supply for supplying an atomized spray of said second alkaline chemical and said oxygen gas to said gas space at the top of said reaction vessel including an atomizing nozzle for subdividing said second alkaline chemical and said oxygen gas into droplets a line communicating with said nozzle and said second source of supply for said second alkaline chemical, and a second line communicating with said nozzle for injecting said oxygen gas into said second alkaline chemical creating said spray.

3. The apparatus of claim 1 or 2 including means for supplying steam to said gas space in said reaction vessels above the level of pulp maintained in said reaction vessels.

4. A process for the continuous oxygen delignification of pulp comprising the steps of combining pulp with a first portion of alkaline chemicals and then introducing said pulp at a consistency of from 8–20% into a substantially horizontal reaction zone while maintaining a gas space at the top of said reaction zone and maintaining said 8–20% consistency throughout said reaction zone, creating a fine spray of alkaline chemicals by (1) injecting oxygen gas under pressure from a first supply line and a second portion of said alkaline chemicals in a second supply line into an atomizing nozzle, and (2) utilizing said oxygen gas in conjunction with said atomizing nozzle to atomize said second portion of said alkaline chemicals and create said fine spray, introducing said fine spray of oxygen gas and said second portion of said alkaline chemicals into the gas space above the level of said pulp in said reaction zone, and transporting said pulp through said reaction zone while agitating said pulp to mix it with said mixture of oxygen gas and alkaline chemicals.

5. The process of claim 4 in which steam is added to said gas space above the level of pulp in said reaction zone at a time later than said mixture of oxygen gas and alkaline chemicals is added.

6. The process of claim 4 in which said alkaline chemicals are selected from the group consisting of sodium hydroxide, sodium carbonate, sodium bicarbonate, kraft white liquor, oxidized kraft white liquor, ammonia, sodium tetraborate, sodium metaborate, and mixtures thereof.

7. The process of claim 6 in which said alkaline chemicals are a mixture of chemicals, with at least one component of said mixture being selected from the group consisting of ammonia, calcium hydroxide, and magnesium hydroxide.

8. A process for the continuous oxygen delignification of pulp comprising the steps of combining pulp with a first alkaline chemical and then introducing said pulp at a consistency of from 8–20% consistency into a substantially horizontal reaction zone while maintaining a gas space at the top of said reaction zone and maintaining said 8–20% consistency through said reaction zone, introducing oxygen gas into said gas space at the top of said reaction zone, introducing a second alkaline chemical, having a chemical composition different than said first alkaline chemical, as a fine spray into said gas space at the top of said reaction zone, said fine spray being created in injecting at least a portion of said oxygen gas from a first supply line into said second alkaline chemical in an atomizing nozzle and utilizing said oxygen gas in conjunction with said atomizing nozzle to atomize said second alkaline chemical and create said fine spray, and transporting said pulp through said reaction zone while agitating said pulp to mix it with said oxygen gas and said first and second alkaline chemicals.

9. The process of claim 8 in which said second alkaline chemical is sodium hydroxide.

10. The process of claim 8 in which said second alkaline chemical is introduced into said reaction zone at least ten seconds after said first alkaline chemical has been combined with said pulp.

11. The process of claim 8 in which steam is added to the space above the level of pulp in said reaction zone at a time later than said second alkaline chemical is added.

* * * * *

UNITED STATES PATENT AND TRADEMARK OFFICE

CERTIFICATE OF CORRECTION

PATENT NO. : 4,431,480

DATED : February 14, 1984

INVENTOR(S) : Larry D. Markham and Vincent L. Magnotta

It is certified that error appears in the above—identified patent and that said Letters Patent is hereby corrected as shown below:

On the title page Assignee should read

--Assignees: The Black Clawson Company
Middletown, Ohio and

Air Products & Chemicals, Inc.
Allentown, Pennsylvania --

Col. 8, line 43, "embodiments" should be --embodiment--.

Col. 10, line 36, "vessel" should be --vessels--.

Signed and Sealed this

Twenty-second Day of May 1984

[SEAL]

Attest:

GERALD J. MOSSINGHOFF

Attesting Officer

Commissioner of Patents and Trademarks